US011185894B2

(12) United States Patent
Wen et al.

(10) Patent No.: US 11,185,894 B2
(45) Date of Patent: Nov. 30, 2021

(54) FEED-THROUGH ULTRASONIC CLEANING SYSTEM FOR WINDING OF LARGE-SIZED SUPERCONDUCTING COILS

(71) Applicant: Hefei Institutes of Physical Science, Chinese Academy of Sciences, Anhui (CN)

(72) Inventors: Wei Wen, Anhui (CN); Guang Shen, Anhui (CN); Yuntao Song, Anhui (CN); Weiyue Wu, Anhui (CN)

(73) Assignee: Hefei Institutes of Physical Science, Chinese Academy of Sciences, Hefei (CN)

( * ) Notice: Subject to any disclaimer, the term of this patent is extended or adjusted under 35 U.S.C. 154(b) by 227 days.

(21) Appl. No.: 16/537,624

(22) Filed: Aug. 12, 2019

(65) Prior Publication Data

US 2019/0366392 A1 Dec. 5, 2019

(51) Int. Cl.

| | |
|---|---|
| ***B08B 3/12*** | (2006.01) |
| ***H01F 41/096*** | (2016.01) |
| ***B08B 3/02*** | (2006.01) |
| ***F26B 21/00*** | (2006.01) |
| ***H01F 41/04*** | (2006.01) |

(52) U.S. Cl.

CPC ..... *B08B 3/123* (2013.01); *B08B 3/02* (2013.01); *F26B 21/00* (2013.01); *H01F 41/048* (2013.01); *H01F 41/096* (2016.01)

(58) Field of Classification Search

None

See application file for complete search history.

(56) References Cited

U.S. PATENT DOCUMENTS 5,447,171 A * 9/1995 Shibano ..... B08B 3/12 134/102.2

FOREIGN PATENT DOCUMENTS

| | | | |
|---|---|---|---|
| CN | 204035118 U | * | 12/2014 |
| CN | 103286093 B | | 5/2015 |
| CN | 103028572 | | 9/2015 |

OTHER PUBLICATIONS

CN204035118U Google Patents translation retrieved on May 20, 2021 (Year: 2021).*

* cited by examiner

*Primary Examiner* — Eric W Golightly

(57) ABSTRACT

A feed-through ultrasonic cleaning system for winding of a superconducting coil, including a sealed chamber system, a main ultrasonic cleaning system, a deionized water spraying system, a compressed air blow-drying system, and an automatic control system. During the winding of an armored superconducting coil, a superconducting conductor which is fed at a constant speed successively passes through a sealed chamber, an ultrasonic cleaning chamber, a first compressed air blow-drying chamber, a deionized water spray chamber, and a second compressed air blow-drying chamber in the ultrasonic cleaning system.

3 Claims, 2 Drawing Sheets

FEED-THROUGH ULTRASONIC CLEANING SYSTEM FOR WINDING OF LARGE-SIZED SUPERCONDUCTING COILS

CROSS-REFERENCE TO RELATED APPLICATIONS

This application claims the benefit of priority from Chinese Patent Application No. 201810101700.8, filed on Feb. 1, 2018. The content of the aforementioned application, including any intervening amendments thereto, is incorporated herein by reference in its entirety.

TECHNICAL FIELD

The present application relates to systems for ultrasonically cleaning superconducting coils, and particularly to a feed-through ultrasonic cleaning system for the winding of large-sized superconducting coils.

BACKGROUND OF THE PRESENT INVENTION

Thermonuclear fusion will provide inexhaustible clean energy for humans. The international thermonuclear experimental reactor (ITER) program will be completed in the next decade. Superconducting magnets provide a required magnetic field for a tokamak, in order to control and constrain high temperature plasma.

During the coil winding, the superconducting conductor is straightened, ultrasonically cleaned, sandblasted, bent, inter-turn insulation wrapped and dropped in the mold to meet requirements on the highly precise size of the superconducting coil. Coil winding is one of the most important steps for manufacturing superconducting magnets. The insulating property of superconducting magnets mainly depends upon the quality of inter-turn insulation and the quality of insulation against ground. The inter-turn insulation treated by vacuum pressure impregnation needs to meet the requirements for the high-voltage insulation and the mechanical strength of bonding between superconducting conductors. The roughness, cleanliness and insulating compression ratio of the surface of the superconducting conductor are important factors that influence the inter-turn insulation and the mechanical strength of bonding between superconducting conductors, wherein the cleanliness of the surface of the superconducting conductor is a crucial factor. Therefore, the feed-through ultrasonic cleaning system that integrates mechanical dynamic sealing, ultrasonic cleaning and automatic control is an important part of a superconducting coil winding production line, and is the key to ensure great inter-turn insulation and mechanical properties of superconducting coils.

SUMMARY OF THE PRESENT INVENTION

An objective of the present invention is to provide a feed-through ultrasonic cleaning system for the winding of a large-sized superconducting coil, to realize the dynamic sealing between the conductor and the cleaning liquid during the conductor feeding process, completely remove oil from the surface of the conductor, and meet the requirements in the water break test.

For this purpose, the present invention employs the following technical solutions.

A feed-through ultrasonic cleaning system for winding of a large-sized superconducting coil, comprising a sealed chamber, an ultrasonic cleaning chamber, a first compressed air blow-drying chamber, a deionized water spray chamber and a second compressed air blow-drying chamber, which successively communicates with each other, wherein:

a superconducting conductor to be cleaned successively passes through the sealed chamber, the ultrasonic cleaning chamber, the first compressed air blow-drying chamber, the deionized water spray chamber and the second compressed air blow-drying chamber;

the sealed chamber communicates with an entrance of the ultrasonic cleaning chamber, and a compressed air nozzle and a spring-loaded wiper are arranged in the sealed chamber to prevent deionized water or ultrasonic cleaning solution from overflowing;

upper and lower ultrasonic vibrators, a first level sensor, a first temperature sensor and a first heating rod are arranged in the ultrasonic cleaning chamber, a first insulating layer is arranged around the ultrasonic cleaning chamber, and the ultrasonic cleaning chamber ultrasonically cleans the superconducting conductor at a certain temperature according to a set power and frequency in order to completely remove oil stain on a surface of the conductor;

the first and second compressed air blow-drying chambers each are provided with pneumatic nozzles which are symmetrically arranged to separate and blow-dry residual cleaning liquid on the conductor, wherein an entrance of the first compressed air blow-drying chamber communicates with an exit of the ultrasonic cleaning chamber; an exit of the first compressed air blow-drying chamber communicates with an entrance of the deionized water spray chamber, and an exit of the deionized water spray chamber communicates with an entrance of the second compressed air blow-drying chamber; and spray nozzles are arranged in the deionized water spray chamber to remove ultrasonic cleaning liquid adhered onto the surface of the conductor and clean the surface of the conductor again by spraying.

The feed-through ultrasonic cleaning system further comprises an ultrasonic cleaning liquid reservoir, a first circulating water pump, a first filter and an ultrasonic wave generator, wherein the ultrasonic cleaning liquid reservoir, the first circulating water pump, the first filter and the ultrasonic wave generator together with the ultrasonic cleaning chamber form a main ultrasonic cleaning system; a second heating rod, a second temperature sensor and a second level sensor are arranged in the ultrasonic cleaning liquid reservoir, and a second insulating layer is arranged around the ultrasonic cleaning liquid reservoir, so that the ultrasonic cleaning liquid is heated and insulated according to a set temperature and a liquid level in the reservoir is detected; the first circulating water pump pumps the ultrasonic cleaning liquid in the ultrasonic cleaning liquid reservoir into the ultrasonic cleaning chamber through the first filter according to a set flow rate and pressure; and the upper and lower ultrasonic vibrators in the ultrasonic cleaning chamber ultrasonically clean the superconducting conductor according to a frequency and power set by the ultrasonic wave generator.

The feed-through ultrasonic cleaning system further comprises a deionized water reservoir, a second circulating water pump and a second filter, wherein the deionized water reservoir, the second circulating water pump and the second filter together with the deionized water spray chamber form the deionized water spraying system; a third level sensor is arranged in the deionized water reservoir, which can detect a level of liquids in the reservoir in real time; the second circulating water pump pumps the deionized water in the deionized water reservoir into the deionized water spray chamber through the second filter according to a set flow rate and pressure; and spray nozzles symmetrically arranged in the deionized water spray chamber remove the ultrasonic cleaning liquid adhered onto the surface of the conductor and clean the conductor again.

The feed-through ultrasonic cleaning system further comprises an automatic control system, wherein the automatic control system enables one-button start and stop the ultrasonic cleaning system, feeds back a fault signal after detecting a failure, and then sends an alarm signal to a main control system for a coil winding production line; and the automatic control system has a clock setting function by which and the ultrasonic cleaning liquid reservoir is started for heating under a pre-set time according to production requirements.

The feed-through ultrasonic cleaning system of the present invention works at a temperature ranging from normal temperature to 100° C., and is applicable to the production line for large-sized superconducting coils to provide clean conductors for the superconducting coil winding. The feed-through ultrasonic cleaning system of the present invention has great application value in the fusion reactor field and the superconducting magnet field.

In fact, reference may be made to the technical solutions of the present invention if it is expected to remove oil and ultrasonically clean feed-through conductors during the winding of a coil. However, any simple modifications, or equivalent changes or variations, made to the structure in accordance with the technical essence of the present invention without departing from the content of the technical solutions of the present invention shall fall within the scope of the technical solutions of the present invention.

The present invention has the following advantages.

The feed-through ultrasonic cleaning system of the present invention is complex in function, but simple in both structure and principle, thereby ensuring the cleanliness of the surface of the conductor during the winding of a superconducting coil, and thus improving the quality of inter-turn insulation. The functions are implemented by different units. The sealed chamber system realizes the dynamic sealing between the cleaning liquid and the conductor. The main ultrasonic cleaning system completely removes oil and cleans the superconducting conductor. The deionized water spraying system removes the residual ultrasonic cleaning liquid on the surface of the conductor and clean the conductor again. The compressed air blow-drying system dehumidifies and dries the surface of the superconducting conductor. The automatic control system enables reliable start and stop, and clock setting of the sub-systems.

DETAILED DESCRIPTION OF THE PRESENT INVENTION

Figure 1:
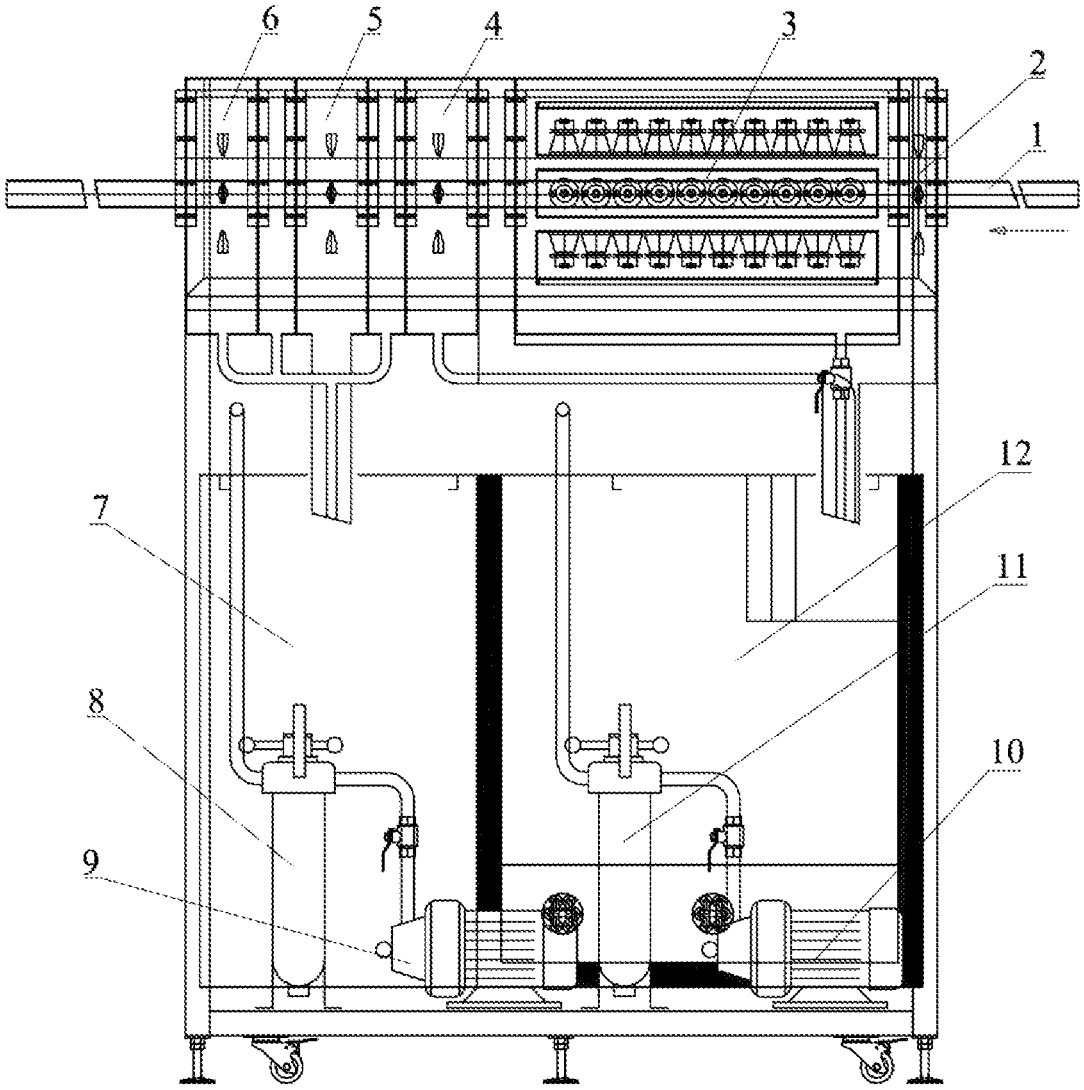
FIG. 1 is a side view of a feed-through ultrasonic cleaning system according to the present invention.
Figure 2:
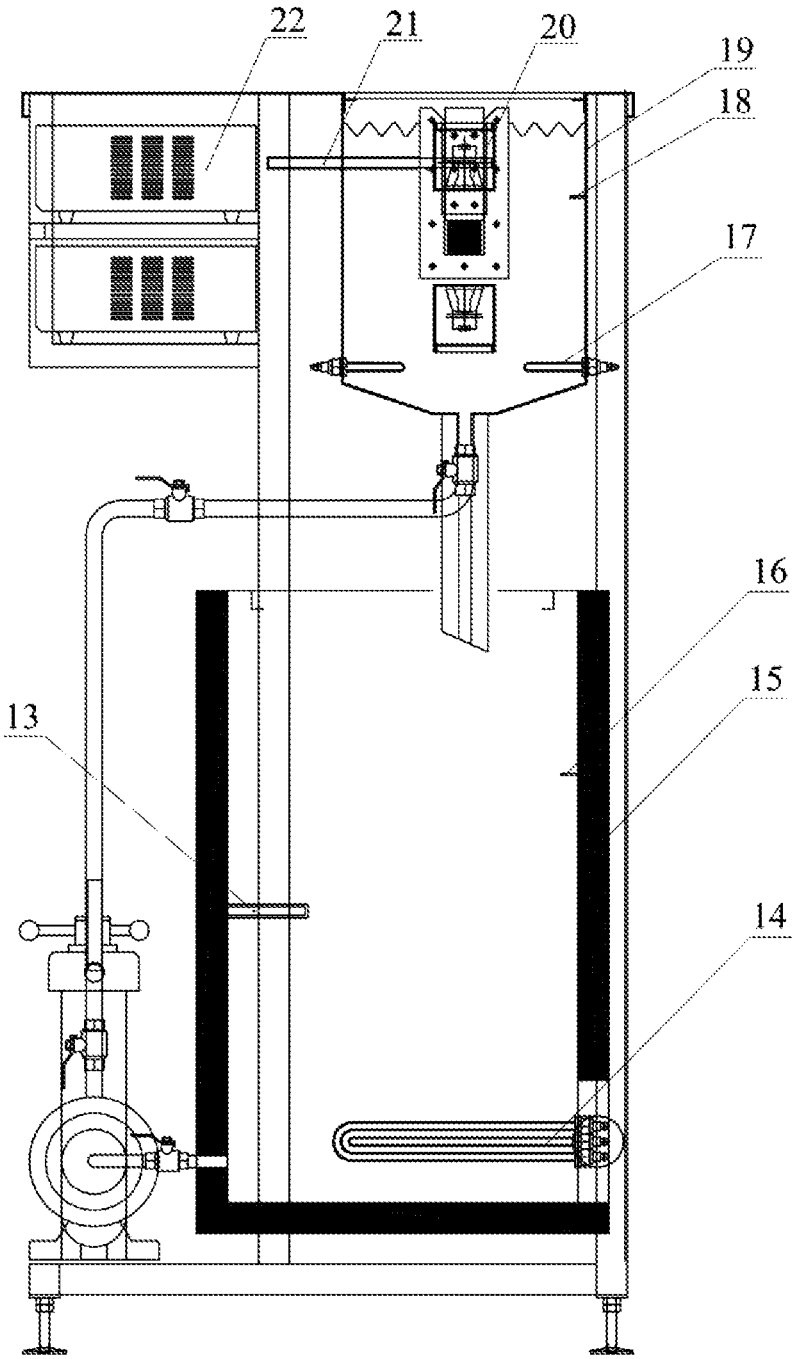
FIG. 2 is a front view of the feed-through ultrasonic cleaning system according to the present invention.

As shown in FIGS. 1 and 2, a feed-through ultrasonic cleaning system for winding of a large-sized superconducting coil comprises a sealed chamber 2, an ultrasonic cleaning chamber 3, a first compressed air blow-drying chamber 4, a deionized water spray chamber 5 and a second compressed air blow-drying chamber 6, which are successively communicated with each other. A conductor 1 to be cleaned successively passes through the sealed chamber 2, the ultrasonic cleaning chamber 3, the first compressed air blow-drying chamber 4, the deionized water spray chamber 5 and the second compressed air blow-drying chamber 6.

The sealed chamber 2 communicates with an entrance of the ultrasonic cleaning chamber 3, and a compressed air nozzle and a spring-loaded wiper are arranged in the sealed chamber 2 to prevent deionized water or ultrasonic cleaning solution from overflowing.

Upper and lower ultrasonic vibrators 20, a first level sensor 21, a first temperature sensor 18 and a first heating rod 17 are arranged in the ultrasonic cleaning chamber 3, a first insulating layer 19 is arranged around the ultrasonic cleaning chamber 3, and the ultrasonic cleaning chamber 3 ultrasonically cleans the superconducting conductor 1 at a specific temperature according to a set power and frequency in order to completely remove oil stain on a surface of the conductor 1.

The first and second compressed air blow-drying chambers 4, 6 each are provided with pneumatic nozzles which are symmetrically arranged to separate and blow-dry the residual cleaning liquid on the conductor 1. An entrance of the first compressed air blow-drying chamber 4 communicates with an exit of the ultrasonic cleaning chamber 3. An exit of the first compressed air blow-drying chamber 4 communicates with an entrance of the deionized water spray chamber 5, and an exit of the deionized water spray chamber 5 communicates with an entrance of the second compressed air blow-drying chamber 6.

Spray nozzles are arranged in the deionized water spray chamber 5 to remove ultrasonic cleaning liquid adhered onto the surface of the conductor 1 and clean the surface of the conductor 1 again by spraying.

The feed-through ultrasonic cleaning system further comprises an ultrasonic cleaning liquid reservoir 12, a first circulating water pump 10, a first filter 11 and an ultrasonic wave generator 22. The ultrasonic cleaning liquid reservoir 12, the first circulating water pump 10, the first filter 11 and the ultrasonic wave generator 22 together with the ultrasonic cleaning chamber 3 form a main ultrasonic cleaning system. A second heating rod 14, a second temperature sensor 13 and a second level sensor 16 are arranged in the ultrasonic cleaning liquid reservoir 12, and a second insulating layer 15 is arranged around the ultrasonic cleaning liquid reservoir 12, so that the ultrasonic cleaning liquid may be heated and insulated according to a set temperature and the liquid level of the reservoir may is detected. The first circulating water pump 10 pumps the ultrasonic cleaning liquid in the ultrasonic cleaning liquid reservoir 12 into the ultrasonic cleaning chamber 3 through the first filter 11 according to a set flow rate and pressure. The ultrasonic vibrators 20 in the ultrasonic cleaning chamber 3 ultrasonically clean the superconducting conductor 1 according to a frequency and power set by the ultrasonic wave generator 22.

The feed-through ultrasonic cleaning system further comprises a deionized water reservoir 7, a second circulating water pump 9 and a second filter 8. The deionized water reservoir 7, the second circulating water pump 9 and the second filter 8 together with the deionized water spray chamber 5 form the deionized water spraying system. A third level sensor is arranged in the deionized water reservoir 7, which can detect the level of liquids in the reservoir in real time. The second circulating water pump 9 pumps the deionized water in the deionized water reservoir 7 into the deionized chamber 5 through the second filter 8 according to a set flow rate and pressure. and spray nozzles symmetrically arranged in the deionized water spray chamber 5 remove ultrasonic cleaning liquid that may be adhered onto the surface of the conductor 1 and clean the conductor 1 again.

The feed-through ultrasonic cleaning system further comprises an automatic control system. The automatic control system enables one-button start and stop of the ultrasonic cleaning system, and detects and feeds back a fault signal and then sends an alarm signal to a main control system for a coil winding production line. Moreover, the automatic control system has a clock setting function by which the ultrasonic cleaning liquid reservoir is started for heating under a pre-set time according to the production requirements.

During the winding of a coil, a superconducting conductor 1 which is fed at a constant speed successively passes through the sealed chamber 2 (in the front end), the ultrasonic cleaning chamber 3, the first compressed air blow-drying chamber 4, the deionized water spray chamber 5, and the second compressed air blow-drying chamber 6 of the ultrasonic cleaning system.

The main ultrasonic cleaning system comprises the ultrasonic cleaning liquid reservoir 12, the first circulating water pump 10, the first filter 11, the ultrasonic wave generator 22, the ultrasonic cleaning chamber 3. The second heating rod 14, the second temperature sensor 13, the second level sensor 16 and the second insulating layer 15 are arranged in the ultrasonic cleaning liquid reservoir 12, so that the ultrasonic cleaning liquid can be heated and insulated according to a set temperature and the level of liquids in the reservoir can be detected. The first circulating water pump 10 pumps the ultrasonic cleaning liquid in the ultrasonic cleaning liquid reservoir 12 into the ultrasonic cleaning chamber 3 through the first filter according to a set flow rate and pressure. The ultrasonic vibrators 20 in the ultrasonic cleaning chamber 3 ultrasonically clean the superconducting conductor 1 according to the frequency and power set by the ultrasonic wave generator. In addition, the first heating rod 17, the first temperature sensor 18, the first level sensor 21 and the first insulating layer 19 are arranged in the ultrasonic cleaning chamber 3. It is ensured that the ultrasonic cleaning liquid is at a set temperature and can be insulated at this temperature, and the level of liquids in the cleaning chamber can be detected.

The deionized water spraying system comprises the deionized water reservoir 7, the second circulating water pump 9, the second filter 8, the deionized water spray chamber 5. A third level sensor is arranged in the deionized water reservoir 7, which can detect the level of liquids in the reservoir in real time. The second circulating water pump 9 pumps the deionized water in the deionized water reservoir 7 into the deionized water cleaning chamber 5 through the second filter 8, according to a set flow rate and pressure. The spray nozzles symmetrically arranged in the deionized water cleaning chamber 5 remove the residual ultrasonic cleaning liquid on the surface of the conductor and clean the conductor again.

The automatic control system realizes the starting and stopping of the feed-through ultrasonic cleaning system by PLC. All control operations can be implemented by a touch screen. The automatic control system includes "Manual" and "Auto" modes. In the "Auto" mode, the automatic starting of the feed-through ultrasonic cleaning system is controlled in the following order:

1) by the clock setting function, the ultrasonic cleaning liquid in the ultrasonic cleaning liquid reservoir 12 is heated and insulated at a certain temperature, 2 hours before the start time of work;

2) the sealed chamber system 2 and the compressed air blow-drying system 4 are started; and 3) the deionized water cleaning system 5 and the main ultrasonic cleaning system 3 are started.

When all systems are started, the automatic control system of the ultrasonic cleaning system provides feedback to the main control system for a coil winding production line. The main control system starts the feeding of the superconducting conductor according to actual requirements.

The automatic stopping of the feed-through ultrasonic cleaning system is controlled in the following order:

1) the deionized water cleaning system 5 and the main ultrasonic cleaning system 3 are stopped; and 2) the sealed chamber system 2 and the compressed air blow-drying system 4 are stopped, after a delay of 2 min.

In addition, all the above operations may be performed separately in the "Manual" mode, if required by the production.

We claim:

1. A feed-through ultrasonic cleaning system for winding of a superconducting coil, comprising a sealed chamber, an ultrasonic cleaning chamber, a first compressed air blow-drying chamber, a deionized water spray chamber, a second compressed air blow-drying chamber, and an automatic control system;

wherein:

the sealed chamber, the ultrasonic cleaning chamber, the first compressed air blow-drying chamber, the deionized water spray chamber and the second compressed air blow-drying chamber are communicated with each other successively;

the sealed chamber communicates with an entrance of the ultrasonic cleaning chamber, and the sealed chamber comprises a compressed air nozzle and a spring-loaded wiper which are configured to prevent deionized water or ultrasonic cleaning solution from overflowing;

the ultrasonic cleaning chamber comprises upper and lower ultrasonic vibrators, a first level sensor, a first temperature sensor and a first heating rod; the ultrasonic cleaning chamber further comprises a first insulating layer, and the ultrasonic cleaning chamber ultrasonically cleans a superconducting conductor at a certain temperature according to a set power and frequency so as to completely remove an oil stain on a surface of the superconducting conductor;

the first and second compressed air blow-drying chambers each comprise pneumatic nozzles which are symmetrically arranged; the pneumatic nozzles are configured to separate and blow-dry residual cleaning liquid on the superconducting conductor, wherein an entrance of the first compressed air blow-drying chamber communicates with an exit of the ultrasonic cleaning chamber; an exit of the first compressed air blow-drying chamber communicates with an entrance of the deionized water spray chamber, and an exit of the deionized water spray chamber communicates with an entrance of the second compressed air blow-drying chamber;

the deionized water spray chamber comprises spray nozzles which are configured to remove ultrasonic cleaning liquid adhered onto the surface of the conductor and clean the surface of the conductor again by spraying; and the automatic control system enables one-button start and stop of the ultrasonic cleaning system, and is configured to detect and feed back a fault signal and then send an alarm signal to a main control system for a coil winding production line; and the automatic control system further has a clock setting function by which the ultrasonic cleaning liquid reservoir is heated for heating under a pre-set time according to production requirements.

2. The feed-through ultrasonic cleaning system of claim 1, further comprising an ultrasonic cleaning liquid reservoir, a first circulating water pump, a first filter and an ultrasonic wave generator, wherein the ultrasonic cleaning liquid reservoir, the first circulating water pump, the first filter and the ultrasonic wave generator together with the ultrasonic cleaning chamber form a main ultrasonic cleaning system; the ultrasonic cleaning liquid reservoir comprises a second heating rod, a second temperature sensor, a second level sensor and a second insulating layer, so that the ultrasonic cleaning liquid is heated and insulated according to a set temperature and a liquid level in the reservoir is detected; the first circulating water pump pumps the ultrasonic cleaning liquid in the ultrasonic cleaning liquid reservoir to the ultrasonic cleaning chamber through the first filter according to a set flow rate and pressure; and the upper and lower ultrasonic vibrators in the ultrasonic cleaning chamber ultrasonically clean the superconducting conductor according to a frequency and power set by the ultrasonic wave generator.

3. The feed-through ultrasonic cleaning system of claim 2, further comprising a deionized water reservoir, a second circulating water pump and a second filter, wherein the deionized water reservoir, the second circulating water pump and the second filter together with the deionized water spray chamber form a deionized water spraying system; the deionized water reservoir comprises a third level sensor which is configured to detect a level of liquids in the deionized water reservoir in real time; the second circulating water pump pumps deionized water in the deionized water reservoir into the deionized water spray chamber through the second filter according to a set flow rate and pressure; and the spray nozzles are symmetrically arranged in the deionized water spray chamber to remove the ultrasonic cleaning liquid adhered onto the surface of the conductor and clean the conductor again.

* * * * *